United States Patent [19]

Boan et al.

[11] Patent Number: 4,812,854

[45] Date of Patent: Mar. 14, 1989

[54] MESH-CONFIGURED RF ANTENNA FORMED OF KNIT GRAPHITE FIBERS

[75] Inventors: Bobby J. Boan, Indian Harbour Beach; Martin Schwam, Indialantic, both of Fla.

[73] Assignee: Harris Corp., Melbourne, Fla.

[21] Appl. No.: 46,144

[22] Filed: May 5, 1987

[51] Int. Cl.[4] ..... H01Q 1/36

[52] U.S. Cl. ..... 343/897; 343/909; 343/912

[58] Field of Search ..... 343/909, 840, 915, 912, 343/897

[56] References Cited

U.S. PATENT DOCUMENTS

| | | | |
|---|---|---|---|
| 3,855,598 | 12/1974 | Keller | 343/915 |
| 4,092,453 | 5/1978 | Jonda | 343/897 |
| 4,439,768 | 3/1984 | Ebneth et al. | 343/909 |
| 4,549,187 | 10/1985 | Levy | 343/897 |
| 4,609,923 | 9/1986 | Boan et al. | 343/897 |

*Primary Examiner*—William L. Sikes
*Assistant Examiner*—Hoanganh Le
*Attorney, Agent, or Firm*—Antonelli, Terry & Wands

[57] ABSTRACT

An antenna reflector material for electromagnetic waves is comprised of knitted strands of fine diameter graphite filaments, which have been individually coated with a stress absorbing layer (e.g. a thin metallic or dielectric cladding). Because of the stress absorbing coating, the graphite fibers, which, by themselves, are inherently brittle and unable to tolerate substantial changes to their bend radius profiles, are able to be successfully knitted into a tricot mesh configuration and thereby yield an antenna surface material that possesses a near-zero coefficient of thermal expansion and a sufficiently low in-plane mechanical stiffness. After the tricot knit graphite mesh material has been formed, the cladding layer may be removed (e.g. by heat or chemically dissolved), without affecting the mechanical properties of the graphite strands of the tricot knit. The intended displacement capability of the loops of graphite strands within the knit mesh structure are retained, so that thermal inputs do not alter the performance characteristics of the graphite mesh antenna.

21 Claims, 1 Drawing Sheet

MESH-CONFIGURED RF ANTENNA FORMED OF KNIT GRAPHITE FIBERS

FIELD OF THE INVENTION

The present invention relates in general to electrically conductive mesh articles and, especially, to those characterized for use as flexible high performance reflective antenna surfaces.

BACKGROUND OF THE INVENTION

Advanced microwave signalling transmission networks, particularly space-deployed communication, command and control ($C^3$) systems, require deployable antennas configured of high performance flexible reflective surfaces. For this purpose knit mesh materials have been demonstrated to provide a sufficiently high level of performance that their continued use as reflector materials can be expected in the future. Unfortunately, conventionally woven mesh structures suffer from a significant problem of high in-plane mechanical stiffness, that can manifest itself through a number of characteristics which can degrade antenna performance, including difficulty in holding surface contour manufacturing tolerances, difficulty in maintaining tension in the surface resulting from thermoelastic effects and distortion of structural support members upon which the antenna mesh is mounted (also resulting from thermoelastic effects on the mesh). As system operating frequencies continue to increase, the stiffness problem becomes more pronounced, since stiffness is inversely proportional to antenna mesh hole size which, in turn, must be made smaller to maintain RF gain.

Fortunately, there has now been developed a mesh configuration which successfully addresses the stiffness problem and is expected to continue to enjoy a degree of performance heretofore unmatched by conventional mesh structures. More particularly, in the U.S. Pat. No. 4,609,923 to Boan et al, entitled Gold-plated Tungsten Knit RF Reflective Surface, issued Sept. 2, 1986 and assigned to the assignee of the present application, there is described a new and improved antenna mesh configuration formed of small diameter (e.g. 0.4–1.5 mil diameter) gold-plated tungsten wire that has been knitted in a tricot knit configuration, so as to be able to effectively absorb thermoelastic changes in the wire and thereby retain the intended shape of the antenna. Namely, because of the inherent properties of its multiple loop structure, a tricot knit configuration is able to permit relative displacement between loops of wire at different portions of the mesh in response to environmental (thermal) changes, so that the intended contour of the antenna is effectively continuously maintained.

The present trend is toward increased RF aperture sizes for space-deployable antennas. These larger diameter structures must maintain high precision contour accuracy over the range of orbital thermal conditions to operate at the higher RF frequencies. To minimize thermoelastic distortions, materials with a near-zero coefficient of thermal expansion (CTE) become particularly attractive. Another factor closely associated with the larger diameter antenna structures is the weight contribution of the RF reflective surface itself. Materials should be selected which minimize the weight per unit area of the paraboloidal reflective surface. For example, a representative weight savings of 30–35 lbs. can be realized for a 150foot diameter antenna by utilizing low-density material for the reflective surface. Materials such as tungsten wire and molybdenum wire are utilized in the design and construction of tricot knit mesh reflective surfaces for space deployable antennas. The basic weight density of these metallic materials significantly exceeds that of some non-metallic materials. In addition, some metallic-materials are subject to sputter degradation in the presence of (non line-of-sight) nuclear radiation.

SUMMARY OF THE INVENTION

In accordance with the present invention, there is provided an enhancement to the metallic knit mesh antenna configuration described in the above-referenced Boan et al Patent, which is less massive, is more tolerant of nuclear radiation (lower Z number), has a substantially lower CTE (and thus less thermal distortion) and operates over a wider temperature range (in a hostile thermal environment). Pursuant to the enhancement of the invention, fine diameter graphite filaments, which have been individually coated with a stress absorbing layer (e.g. a thin metallic or organic cladding), are assembled into yarn bundles of a size corresponding to the tow parameters of a tricot knitting machine. Because of the stress absorbing coating, the graphite fibers, which, by themselves, are inherently brittle and unable to tolerate substantial changes to their bend radius profiles, are able to be successfully knitted into a tricot mesh configuration and thereby yield an antenna surface structure that possesses the sought-after in-plane stiffness characteristics discussed above. After the tricot knit graphite mesh structure has been formed the cladding layer may be removed (e.g. by heat or chemically dissolved), without affecting the mechanical properties of the graphite strands of the tricot knit. The intended displacement capability of the loops of graphite strands within the knit mesh structure are retained, as the fibers now possess a shape that will not be subjected to the twisting and bending forces imparted by the knitting process. In the contour of the antenna reflector surface, the loops of the tricot knit mesh behave (physically) in the same manner as the gold-plated tungsten wire of the antenna of the above-referenced Patent, so that thermal inputs do not alter the performance characteristics of the graphite mesh antenna. Further, graphite has a very low coefficient of thermal expansion (one measured CTE of graphite configuration is $-0.23\times10^{-6}$ppm/° F.) compared with that of tungsten (CTE of Tungsten is $+2.5\times10^{-6}$ppm/° F.), so that there is less sliding of the loops of a graphite tricot knit mesh.

DETAILED DESCRIPTION

Figure 1:
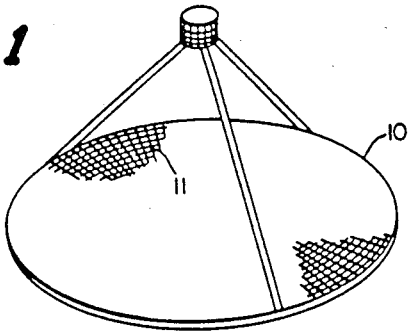
FIG. 1 is a perspective view of a mesh radio wave antenna reflector.
Figure 2:
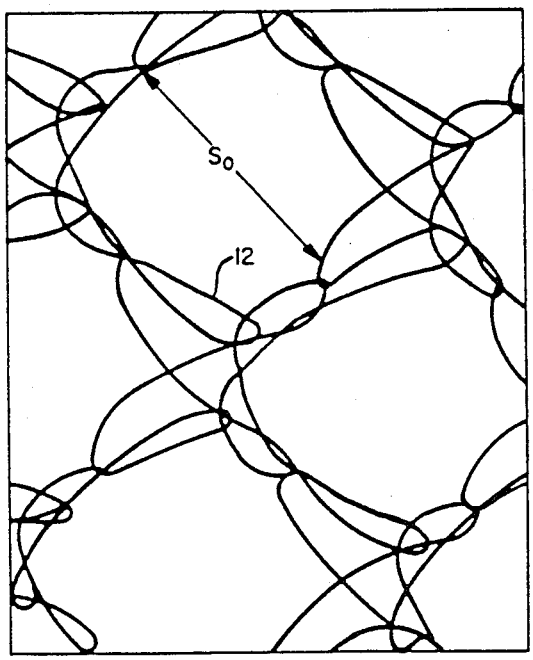
FIG. 2 is an enlarged detailed view of a tricot knit mesh construction.

Referring now to FIG. 1, there is shown a typical antenna structure in which the improved graphite knit-mesh material of the present invention may be incorporated. As shown in FIG. 1, the antenna comprises a paraboloid dish 10 made of a network of fibers 11 the spacing or hole diameter among which being determined by the frequency of the RF energy to be reflected. As described briefly above, the knit mesh is preferably a tricot type mesh configuration which, as shown in detail in FIG. 2, is defined by multiple loops with at least one of the loops being folded back upon itself, such that relative displacement between the loops at different portions of the mesh is permitted, thereby enabling the loops at relatively different portions of the mesh structure to pass by one another and enter open regions of the mesh, and thereby be effectively mechanically displaceable with respect to one another in the contour of the mesh in response to changes in environmental (e.g. thermal) conditions. As a consequence of this ability of the loops to be mechanically displaceable in response to thermal changes, as well as the very low CTE of the graphite fibers, the effective contour of the antenna formed by the mesh is effectively continuously maintained.

Moreover, the type of mesh structure which is obtained by a tricot knit has good mechanical properties, both from a standpoint of manufactureability and handleability. The opening size of the mesh, i.e. the spacing $S_o$ between loops may lie within a range of 3–90 openings per inch. Since the mesh is tricot, having inherent multiple twist loop properties, a tear or cut in the mesh does not propagate.

Figure 3:
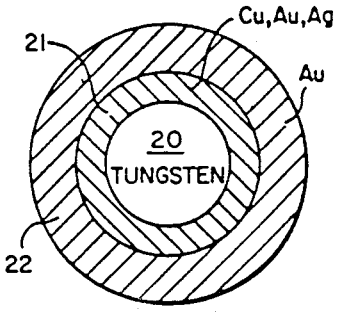
FIG. 3 PRIOR ART
FIG. 3 is a cross-sectional view of an individual gold-plated tungsten wire fiber of the antenna mesh material described in the above-identified Patent.

In order to fully appreciate the improvement provided by the use of bundled graphite fibers in the tricot knit mesh configuration of FIG. 2, it is initially useful to examine the make-up of the metallic structure of the mesh material disclosed in the above-referenced Boan et al patent. Referring to FIG. 3, which shows a cross-sectional view of an individual gold-plated tungsten fiber employed in such a tricot knit mesh, each individual strand of the mesh is comprised of a tungsten center conductor 20 surrounded by a gold layer 22. The diameter of the tungsten center conductor 20 may be on the order of 0.4–1.5 mils. An understrike layer 21 of gold, copper, silver or a combination of these metals, having a thickness on the order 5 microinches, may be coated on the outer surface of the tungsten center conductor 20. This dual core is then surrounded by gold cladding layer 22 the thickness of which is typically on the order of 5 microinches to 100 microinches.

Because of the inherent physical properties of the metals of which the gold plated tungsten fiber shown in FIG. 3 is made, it may be drawn to very fine diameters (as fine as 0.4 mils) and still maintain sufficient tensile strength. However, as noted previously, being made of a metal with high atomic number and atomic mass, each fiber possesses substantial density and is subject to sputter degradation (erosion) in the presence of nuclear radiation.

Pursuant to the present invention, an enhancement of the knit mesh material shown in FIG. 3 and described in the abovereferenced patent involves the formation of bundles or strands of extremely fine diameter (e.g. 5–40 microinches) graphite filaments which, when knitted, provide the requisite in-plane mechanical stiffness supplied by the gold-plated tungsten wires of the above-referenced patented configuration, yet offer improved (reduced) density and radiation tolerance, as well as possessing an order of magnitude lower coefficient of thermal expansion, which assists in maintaining surface stability over a wider range of temperatures.

Figure 4:
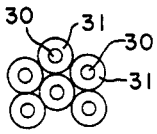
FIG. 4 is a cross-sectional view of a portion of an individual cladded multifiber graphite bundle of which the knit mesh antenna material of the present invention is formed.
Figure 5:
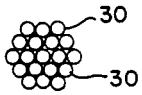
FIG. 5 is a cross-sectional view of the portion of the multifiber graphite bundle of FIG. 4 with the cladding layers removed.

More particularly, with reference to FIG. 4, there is shown a cross-sectional illustration of a portion of a bundle of cladded graphite fibers 30, each fiber having a cladding layer 31 formed of a metallic or organic material, so as to provide elasticity to what is otherwise an extremely brittle filament. An individual graphite filament, regardless of its diameter, is inherently brittle and has only a limited bend radius. Coating each of the individual fibers with a material that has an elastic, stress-absorbing property, such as an organic layer of polyurethane, silicone, epoxy, or acryllic on the order of 5–250 microinches thickness, or a metallic layer of gold, silver, rhodium, platinum, palladium or alloys thereof having a thickness on the order of 5–100 microinches, permits the resulting cladded filament to be subjected to the radial bend stresses that the individual graphite filaments themselves cannot tolerate.

For purposes of the present invention, metal-plated graphite filaments, such as those commercially available in 6,000 tows or bundles from American Cyanamid Corporation may be employed. The 6,000 filaments per bundle size is, from a practical standpoint, too large to be successfully knitted in a commercial tricot knitting machine. In their commercially sold form, the 6,000 plated filament bundles are bunched together in the manner of a bird's nest, but with relative movement among individual fibers being afforded, are separated by gathering portions of the nested bundle together along the length of the bundle and removing a reduced number filament tow. It has been found that tows on the order of 300–500 filaments per bundle may be satisfactorily gathered into strand diameter that are compatible with the threading parameters of commercial tricot knitting machines.

As provided by the manufacturer, the multithousand filament tow bundles (e.g. 6,000 filaments per tow) are surrounded by a protective sheath or coating of organic (usually epoxy-compatible sizing) material that may be readily removed by burning or dissolving. With this sheath removed, the fiber bundle nest may be separated into the smaller numbered filament tows from which yarn strands that are compatible with knitting machine parameters are formed. The separated, reduced number tows are then warped onto the spools employed by the knitting machine and the tricot antenna mesh material is knitted.

In its knitted form, the tricot antenna mesh has the same configuration as the metallic knitted mesh, corresponding to the multiple loop configuration illustrated in FIG. 2. However, unlike the individual gold-plated tungsten wires of which the tricot knit mesh antenna filaments describes in the abovereferenced patent are formed, the strand loops of the knit mesh of the present invention are comprised of multiple strands of extremely fine plated graphite filaments. Because of the coating of the elastic cladding, such as those mentioned above, there is an acceptable (minimal) level of breakage of the graphite filaments during the knitting process.

After the tricot knit mesh antenna material has been knit, the cladding material that surrounds the individual graphite filaments may be removed by heat (e.g. burning) or by chemically dissolving the cladding. Removal of the cladding does not result in breakage of the graphite fibers, since the fibers have been bundled and woven to a new configuration without the application of destructive stress and shear forces to the filaments (absorbed by the cladding layers). The resulting knit mesh graphite antenna material is made up of bundled fibers which now possesses a configuration (multiple loops of the tricot knit mesh) that will behave physically with the intended displacement inherently possessed by the loops of a tricot knit mesh, so that the intended geometry of the antenna made with such material is retained, even in the presence of substantial thermal differential inputs.

When comparing the configuration of a cross-section of an individual wire of the gold-plated tungsten tricot knit mesh of the above-referenced patented scheme with the multifilament strands of the tricot knit mesh of the present invention, it is to be observed that the present invention does not involve simply substituting graphite for the core material of the monofilament of the patented scheme. As noted above, a typical core diameter of the tungsten center conductor 20 shown in FIG. 3 may be on the order 0.4–1.5 mils. Using a 1 mil core diameter as an average, a graphite fiber of such a diameter is extremely brittle. Surrounding such a large diameter graphite core with a cladding layer that is sufficiently thick to absorbed the bending forces to which the filament would be subjected in the course of a knitting process would require a cladding thickness on the order of 500–1500 microinches so that what would result would be effectively a rod, which would neither bend nor be knittable in the manner of a tricot knitting process.

Although, in the foregoing description of a preferred embodiment of the present invention the respective cladding layers which surround the individual graphite fibers are removed after the knitting process, it has been found that their non-removal (particularly where the cladding layer is highly conductive (e.g. gold)) does not necessarily degrade the performance characteristics of the antenna material. Thus, an antenna material made of knit strands of gold-clad graphite filaments provides high performance electromagnetic reflector properties and, even with the gold cladding being sputtered away in response to nuclear radiation, the underlying graphite filaments, which are substantially impervious to non line-of-sight nuclear radiation (as contrasted with an all metal filament in which the underlying core is also subject to nuclear erosion), continue to provide the necessary conductivity so as to enable the antenna to function.

While we have shown and described an embodiment in accordance with the present invention, it is to be understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed is:

1. An antenna for electromagnetic waves comprising a conductive open mesh formed of strands of filaments of carbon-containing material, each strand being formed of a bundle of plural filaments of carbon-containing material in which relative movement among filaments of the bundle is afforded, with each opening of said mesh being defined by multiple loops of said strands, wherein at least one of said loops is formed by the same strand folded back upon itself, the mesh being configured such that relative displacement between loops at different portions of the mesh is permitted, thereby enabling the loops of said strands of filaments of carbon-containing material at relatively different portions of the mesh to pass by one another and enter open regions of the mesh, so as to be effectively mechanically displaceable with respect to one another in the contour of the mesh in response to changes in environmental conditions, whereby the effective contour of the antenna formed by the mesh is retained.

2. An antenna according to claim 1, wherein said filaments of carbon-containing material comprise graphite filaments.

3. An antenna according to claim 2, wherein the diameter of individual ones of said graphite filaments lies in a range from 5 to 40 microinches.

4. An antenna according to claim 2, wherein each of said graphite filaments is coated with a respective distortive force absorbing cladding layer.

5. An antenna according to claim 2, wherein each of said graphite filaments is coated with a respective layer of conductive or RF transparent material

6. An antenna according to claim 2, wherein each of said graphite filament is coated with a respective metallic layer.

7. An antenna according to claim 1, wherein said mesh is formed as a knit mesh having multiple twist loops such that a tear or cut in the mesh does not propagate.

8. An antenna for electromagnetic waves comprising conductive strands made up of a plurality of graphite filaments formed as an open knit mesh, each strand being formed of a bundle of plural filaments of carbon-containing material in which relative movement among filaments of the bundle is afforded, with each opening of said mesh being defined by multiple loops of said strands, wherein at least one of said loops is formed by the same strand folded back upon itself, the mesh being configured such that relative displacement between loops at different portions of the mesh is permitted, thereby enabling the loops of graphite strands at relatively different portions of the mesh to pass by one another and enter open regions of the mesh, so as to be effectively mechanically displaceable with respect to one another in the contour of the mesh in response to changes in environmental conditions, whereby the effective contour of the antenna formed by the mesh is retained.

9. An antenna according to claim 8, wherein the diameter of individual ones of said graphite filaments lies in a range from 5 to 50 microinches.

10. An antenna according to claim 8, wherein said knit mesh has multiple twist loops such that a tear or cut in the mesh does not propagate.

11. An antenna according to claim 8, wherein each of said graphite filaments is coated with a respective distortive force absorbing cladding layer.

12. An antenna according to claim 8, wherein each of said graphite filaments is coated with a respective layer of conductive or RF transparent material.

13. An antenna according to claim 8, wherein each of said graphite filaments is coated with a respective metallic layer.

14. A method of forming an electromagnetic wave reflective material for use as an antenna comprising the steps of:

(a) providing a plurality of carbon-containing filaments each of which is coated with a cladding layer of mechanical force absorbing material so as to impart elasticity to each clad filament;

(b) assembling multiple ones of said coated carbon-containing filaments into strands; and (c) forming an open mesh of strands of said coated carbon-containing filaments, each strand being formed of a bundle of plural filaments of carbon-containing material in which relative movement among filaments of the bundle is afforded, with each opening of said mesh being defined by multiple loops of said strands, wherein at least one of said loops is formed by the same strand folded back upon itself, the mesh being configured such that relative displacement between loops at different portions of the mesh is permitted, thereby enabling the loops of coated filaments at relatively different portions of the mesh to pass by one another and enter open regions of the mesh, so as to be effectively mechanically displaceable with respect to one another in the contour of the mesh in response to changes in environmental conditions, whereby the effective contour of the antenna formed by the mesh is retained.

15. A method according to claim 14, further including the step of:

(d) removing the cladding layers from the filaments within the strands of which said open mesh has been formed by step (c).

16. A method according to claim 14, wherein step (c) comprises knitting said strands of filaments to form said open mesh.

17. A method according to claim 16, wherein said knit mesh has multiple twist loops such that a tear or cut in the mesh does not propagate.

18. A method according to claim 14, wherein said carboncontaining filaments comprise graphite filaments.

19. A method according to claim 18, wherein the diameter of individual ones of said graphite filaments lies in a range from 5 to 40 microinches.

20. A method according to claim 18, wherein each of said graphite filaments is coated with a respective layer of conductive or RF transparent material.

21. A method according to claim 18, wherein each of said graphite filaments is coated with a respective metallic layer.

* * * * *